US010464796B2

(12) United States Patent
Jones et al.

(10) Patent No.: US 10,464,796 B2
(45) Date of Patent: Nov. 5, 2019

(54) MODULATED PRESSURE CONTROL OF BEER FILL FLOW

(71) Applicant: Codi Manufacturing, Inc., Golden, CO (US)

(72) Inventors: Jared Jones, Golden, CO (US); William Jones, Arvada, CO (US); Matthew Wetterlin, Littleton, CO (US)

(73) Assignee: CODI MANUFACTURING, INC., Golden, CO (US)

( * ) Notice: Subject to any disclaimer, the term of this patent is extended or adjusted under 35 U.S.C. 154(b) by 352 days.

(21) Appl. No.: 15/586,066

(22) Filed: May 3, 2017

(65) Prior Publication Data

US 2017/0320717 A1 Nov. 9, 2017

Related U.S. Application Data

(60) Provisional application No. 62/331,382, filed on May 3, 2016.

(51) Int. Cl.

| | |
|---|---|
| ***B67C 3/00*** | (2006.01) |
| ***B67C 3/10*** | (2006.01) |
| ***B67C 3/26*** | (2006.01) |
| ***B67C 7/00*** | (2006.01) |

(52) U.S. Cl.

CPC ..... *B67C 3/007* (2013.01); *B67C 3/008* (2013.01); *B67C 3/10* (2013.01); *B67C 3/2614* (2013.01); *B67C 7/00* (2013.01); *B67C 2003/2657* (2013.01)

(58) Field of Classification Search

CPC . B67C 2003/2657; B67C 3/2614; B67C 3/10; B67C 3/007; B67C 7/00

USPC ..... 53/432

See application file for complete search history.

(56) References Cited

U.S. PATENT DOCUMENTS

| | | | | |
|---|---|---|---|---|
| 4,360,045 | A | 11/1982 | Ahlers | |
| 4,442,954 | A * | 4/1984 | Bergandy | F16K 7/045 137/488 |
| 4,949,764 | A | 8/1990 | Clusserath | |
| 4,976,295 | A | 12/1990 | Clusserath | |
| 5,000,234 | A | 3/1991 | Weiss | |
| 5,040,574 | A | 8/1991 | Petri et al. | |
| 5,119,853 | A | 6/1992 | Petri et al. | |
| 5,161,585 | A * | 11/1992 | Murao | B67C 3/06 141/145 |
| 5,220,946 | A | 6/1993 | Murao et al. | |
| 5,413,153 | A * | 5/1995 | Zwilling | B65B 39/004 141/302 |
| 5,558,135 | A | 9/1996 | Kronseder et al. | |

(Continued)

*Primary Examiner* — Robert F Long
*Assistant Examiner* — Xavier A Madison
(74) *Attorney, Agent, or Firm* — Optima Law Group, APC; Craig W. Barber; Thomas E. Jurgensen

(57) ABSTRACT

A method and apparatus of filing beer for craft breweries combines pressurized beer delivery (rather than gravity feed) with variable pressure control of the beer flow into the can. By modulating beer flow and especially beer pressure, it is possible to fill a can's widget (gas reservoir) with gas with a shorter set of fill steps. In addition, the speed of beer filling can be dramatically increased compared to small scale systems normally used by craft brewers. Unlike known large scale pressure systems, the beer bowl may be located beneath the rest of the apparatus and modulated pressure may be used, making for a smaller and more portable unit.

11 Claims, 9 Drawing Sheets

(56) References Cited

U.S. PATENT DOCUMENTS

| | | | | |
|---|---|---|---|---|
| 6,308,752 | B1 | 10/2001 | Tsukano et al. | |
| 6,601,261 | B1 | 8/2003 | Holt et al. | |
| 2011/0303322 | A1* | 12/2011 | Clusserath | B67C 3/04 141/8 |
| 2014/0305541 | A1* | 10/2014 | Jenne | B67C 3/06 141/6 |
| 2016/0016774 | A1* | 1/2016 | Clusserath | B67C 3/10 141/7 |

* cited by examiner

MODULATED PRESSURE CONTROL OF BEER FILL FLOW

RELATED APPLICATION(S)

This application claims the priority and benefit of U.S. Provisional Application No. 62/331,382 filed May 3, 2016 in the name of the same inventors, and having the same title, the entire disclosure of which is incorporated herein by this reference.

FIELD OF THE INVENTION

The present invention relates generally to the bottling of liquids or semiliquids using bottling apparatus or the like, such as might be found in CPC class B67C, and mores specifically to bottling of pressurized beverages such as beer which require special handling in order to preserve taste qualities relating to gas content of the liquid.

BACKGROUND

Bottling of beer is generally done at two different scales: very large scale commercial operations (for example, major label beer makers) and very small scale commercial operations (for example, craft breweries).

The bottling of beer using machinery in large scale operations requires enormous amounts of space. A typical commercial bottling machine will have a donut shaped bowl (supply tank) a number of feet across and quite high off of the facility floor. Under the periphery of this large industrial tank a conveyor will carry empty cans to a large number (sometimes over 100) indexing stations, where a large number of fill heads may fill the cans. The speed of production is quite high but the cost of the equipment is also quite high: a million dollars is not uncommon.

Such equipment tends to use one of two filling control methods: there are dosing chamber designs and flow metering designs. In every case, the use of on-off valves to control the flow of the pressurized beer is standard (the beer contains CO2 in solution and thus must be pressurized to maintain flavor). The mechanical designs use some variation on a float valve or ball valve to mechanically stop the flow of beer at the correct moment. An inductive sensor or the like may be used to control the binary (on-off) valve. Volumetric designs use a pre-displaced (similar to being pre-measured) dosing chamber, or time the flow of beer into the can or use a flow meter, etc.

In either case it is absolutely of the first importance to use the equalization of gas pressure during the process. If at any time the pressure is simply chopped off, instantly reduced to ambient air pressure, the CO2 in the beer will burst into bubbles and the beer will foam out of the open-topped can.

A fairly typical volumetric can filler for large scale production may be seen at https://www.khs.com/en/products/single-machines/filling/can/beer/volumetric-filing-system.html?scroll=0.

Widgets in beer cans require even further special handling of pressure. A widget, such as the widgets made by the Ball Company, are small pressure reservoirs actually located within the can. The widget is affixed (usually be food-grade glue) to the dome of the can (the interior bottom). The widget has two very small apertures (½ mm or even less). In production, the can is first pressurized repeatedly with CO2 or N2 to purge out oxygen, which must be removed before bottling of the beer. During this, the CO2 or N2 charges the widget through the apertures. Instructions from the widget maker are to use a pressure cycle which is on-off-on-off (4 seconds-6 seconds-4 seconds-6 seconds) and which consumes a fair amount of time. At certain steps in the process, inverting the can (upside down) may be required. Then when (flat) beer is put into the can at the approximate pressure of the widget gas, the lack of pressure differential and the small size of the apertures prevents the gas from exiting the widget. Thus the beer can is shipped with the gas in the widget charged until the can is opened. The pressure instantly decreases dramatically and the widget instantly uncharges through the small ports, providing the gas into the beer in the can.

Modern craft breweries tend to use a different system, such as that seen at https://www.youtube.com/watch?v=gxFrJzxxR _k. This relatively simple machine is much smaller, more suited to the space available to a microbrewery. It tends to cost in the range of one tenth of a million dollars. However, it may be seen to use a simple gravity feed system and to have only four indexing stations which actually fill beer, thus only four cans are filled simultaneously, which dramatically slows production. It may also be seen to be non-pressurized, as the purging is done by lowering four probes into the four cans at four more indexing stations prior to the four filling stations. An optional seamer may be used after the process to put the top onto the full cans. Production is very slow.

U.S. Pat. No. 5,040,574 (and U.S. Pat. Nos. 5,119,853 and 5,000,234) show a typical mechanically actuated (cam actuated) gas inlet system and outlet system (the "snift" valves). U.S. Pat. No. 5,220,946 is a rather more similar system which does not disclose any details of the valving, in particular, it does not teach toward variable valve control.

U.S. Pat. No. 5,558,135 teaches a CO2 supply valve and a return valve which are both opened and closed to control fill pressure and pressure relief. However, that application states "For decelerating the filling process, the return gas valve can be periodically opened and closed . . . ." Thus this item teaches away from modulating the valve opening. U.S. Pat. No. 6,308,752 teaches that some snifting back through the stem may be possible, and teaches a controller that monitors fluid flow rate and actuates the valves to control purging, filling and gradual venting. Various items which use controllers are known, as is the use of multiple valves (for example, U.S. Pat. No. 66,012,618). U.S. Pat. No. 4,976,295 is one of a type which uses the traditional cam-actuated rotary valves for filling but also incorporates electrical/air operated valves in the vent lines to control filling rate. In these cases the flow rate is controlled for narrow bottle necks and thus it does not apply to canning. In FIG. 3, a valve is shown which may have flow cross-sectional area altered, apparently to vary filling rates into the container. U.S. Pat. Nos. 4,949,764 and 4,360,045 may be similar.

SUMMARY OF THE INVENTION

The present invention teaches a beer filling apparatus which uses at least one modulated variable pressure pinch valves to control exhaust of CO2 from the can after purge, thus controlling the inflow of beer into the can.

By this means, the danger of a burst of beer leaving the can (due to bubble formation) when pressure is removed may be reduced or eliminated: the pressure may be brought off the can gradually. Beer flow speed control also allows better avoidance of bubble formation.

The device of the invention may use the large scale technique of pressurized filling in a machine small enough and inexpensive enough for craft brewers to purchase and us in limited production spaces.

A seamer on the machine aids in further speeding production, so that craft production speeds may be easily exceeded, according to testing.

Yet further in addition, the beer supply bowl may be placed beneath the fill heads and conveying equipment, so that the center of gravity is lower and the machine becomes even further portable. In embodiments, the machine may be on wheels and even be moved through standard size doorways.

In addition, unlike some types of large scale machines, there is no need for premeasurement of portions.

In method embodiments, the prior art sequence of on-off-on-off widget purging and filling with inert gas can be changed to a sequence in which the pressure is removed gently (snift) and the widget remains pressurized with the CO2. In addition, inverting the can is never necessary while charging a widget and filling the can.

In addition, a variable valve may be used in alternative embodiments from the CO2 (or N2) pressure source. These, and other, embodiments of the invention will be better appreciated and understood when considered in conjunction with the following description and the accompanying drawings. It should be understood, however, that the following description, while indicating various embodiments of the invention and numerous specific details thereof, is given by way of illustration and not of limitation. Many substitutions, modifications, additions and/or rearrangements may be made within the scope of the invention without departing from the spirit thereof, and the invention includes all such substitutions, modifications, additions and/or rearrangements.

SUMMARY IN REFERENCE TO THE CLAIMS

It is therefore a first aspect, advantage, objective and embodiment of the present invention to provide a beer filling machine for use with a beer can having an open top and a widget, the beer filling machine comprising:

a first fill station, the first fill station dimensioned and configured to hold such beer can in place for filling;

a fill head dimensioned and configured to be lowered to sit atop such beer can, the fill head in liquid and gas communication with such beer can;

a beer supply bowl located below the fill head;

a pressurized gas source;

a first beer conduit connecting the beer supply bowl to the fill head;

a second gas conduit connecting the gas source to the fill head;

a third gas conduit connecting the fill head to the beer supply bowl head space;

a fourth snift line connecting the fill head to a purge;

a first variable progressive valve on the snift line;

a second variable progressive valve on the second gas conduit;

a third variable progressive valve on the third gas conduit;

whereby such can may be filled from the beer supply bowl by means of variable controlled pressure controlled by the variable progressive valves, and further whereby such widget may be filled with gas from the gas source by means of variable controlled gas pressure controlled by the variable progressive valves.

It is therefore a second aspect, advantage, objective and embodiment of the present invention to provide a beer filling machine wherein the gas is one member selected from the group consisting of: CO2, N2, other inert gases, other food-grade gases, and combinations thereof.

It is therefore another aspect, advantage, objective and embodiment of the present invention to provide a beer filling machine further comprising:

a seamer disposed adjacent the first fill station, the seamer operative to affix a top to such can.

It is therefore another aspect, advantage, objective and embodiment of the present invention to provide a beer filling machine for use with a second can having therein a second widget, the beer filling machine further comprising:

a second fill station, the second fill station dimensioned and configured to hold such second beer can in place for filling;

a second fill head dimensioned and configured to sit atop such second beer can, the second fill head in liquid and gas communication with such second beer can;

a fifth beer conduit connecting the beer supply bowl to the second fill head;

a sixth gas conduit connecting the gas source to the second fill head;

a seventh gas conduit connecting the second fill head to the beer supply bowl;

an eighth snift line connecting the second fill head to the purge;

a fourth variable progressive valve on the eighth snift line;

a fifth variable progressive valve on the third gas conduit;

whereby such second can may be filled from the beer supply bowl by means of variable controlled pressure controlled by the variable progressive valves, simultaneously with the filling of such first can;

and further whereby such second widget may be filled with gas from the gas source by means of variable controlled gas pressure controlled by the variable progressive valves, simultaneously with the filling of such first can's widget.

It is therefore another aspect, advantage, objective and embodiment of the present invention to provide a beer filling machine further comprising: the variable progressive valves being controlled by variable air pressure lines.

It is therefore another aspect, advantage, objective and embodiment of the present invention to provide a beer filling machine further comprising: a means for positioning such can in the first fill station and repositioning such can in such seamer.

It is therefore another aspect, advantage, objective and embodiment of the present invention to provide a beer filling machine further comprising a programmable logic controller operative to control the first through fifth valves by controlling the variable air pressure lines, and further operative to control the pressurized gas source, the lowering of the fill head and the means for positioning the can.

It is therefore yet another aspect, advantage, objective and embodiment of the present invention to provide a method of filling a beer can having an open top and a widget, the method comprising the steps of:

providing a beer filling machine comprising: a first fill station, the first fill station dimensioned and configured to hold such beer can in place for filling; a fill head dimensioned and configured to sit atop such beer can, the fill head in liquid and gas communication with such beer can; a beer supply bowl located below the fill head; a pressurized gas source; a first beer conduit connecting the beer supply bowl to the fill head; a second gas conduit connecting the gas source to the fill head; a third gas conduit connecting the fill head to the beer supply bowl; a fourth snift line connecting the fill head to a purge; a first variable progressive valve on the snift line; a second variable progressive valve on the second gas conduit; and a third variable progressive valve on the third gas conduit; a seamer adjacent the first fill station;

positioning such can in the first fill station;

sealing the fill head to the top of such beer can;

in a first pressurization and first purge step, opening the first and second variable progressive valves so that gas flows from the pressurized gas source via the second gas conduit to the fill head and then into such can while allowing air within such can to leave the can via the fourth snift line, thereby pressurizing the can and the widget with gas;

in a second pressurization and purge step, closing the first and second variable progressive valves and opening the third variable progressive valve so that such can becomes pressurized from the beer supply bowl rather than the gas source and allowing pressure in such can to equalize to pressure in the beer supply bowl and creating counterpressure for later steps of the filing;

maintaining the counter pressure while supplying liquid from the beer supply bowl to such can via the first beer conduit;

allowing the liquid to settle in such can whereby gas remaining in such can gathers at the top of such can;

snifting the can by closing the third progressive variable valve and closing the first beer conduit, but partially opening the first variable progressive valve on the fourth snift line, the partial opening sufficient to allow such can to depressurize down to an ambient air pressure by purging via the fourth snift line but insufficient to cause such widget to depressurize;

moving such can to a seamer;

seaming a top onto such can.

It is therefore yet another aspect, advantage, objective and embodiment of the present invention to provide a method of filling a beer can further comprising:

providing variable air pressure lines;

controlling the variable progressive valves by means of variable air pressure lines.

It is therefore yet another aspect, advantage, objective and embodiment of the present invention to provide a method of filling a beer can further comprising: providing a means for positioning such can in the first fill station and repositioning such can in such seamer.

It is therefore yet another aspect, advantage, objective and embodiment of the present invention to provide a method of filling a beer can further comprising:

providing a programmable logic controller operative to control the first through fifth valves by controlling the variable air pressure lines, and operative to control the pressurized gas source, the lowering of the fill head and the means for positioning the can.

INDEX TO THE REFERENCE NUMERALS

Beer can, open top 100
Widget 102
Lower opening 104
Upper opening 106
Can 200
Fill head assembly 210
CO2 inlet/outlet line 212
Outlet line/snift line 214
Liquid inlet line 216
Fill head assembly 310
CO2 inlet/outlet line 312
Outlet line/snift line 314
Liquid inlet line 316
Beer filling machine 320
Beer filling station 322
Beer supply bowl 324
Beer 326
CO2 above beer/bowl head space 328
Gas source 330
Head to bowl CO2 line 332
Variable progressive valve
Variable progressive valve 336
Second fill head assembly 340
CO2 inlet/outlet line 342
Outlet line/snift line 344
Liquid inlet line 346
Second beer filling station 352
Head to bowl CO2 line 362
Variable progressive valve 364
Variable progressive valve 366
Pressure transducer 401
Indexing worm drive 403
Purge manifold 405
On/off valve 407
Coupling for control line (air) 409
Fill head assembly 410
CO2 inlet/outlet line 412
Outlet line/snift line 414
Liquid inlet line 416
Beer filling machine 420
Beer filling station 422
Beer supply bowl 424
CO2 above beer in bowl 428
Gas source 430
Variable progressive valve 434
Variable progressive valve 436
Index can into position 502
Seal fill head to can top 504
Provide gas via var-press valve 506
Allow Oxygen to escape 508
Pressurize from beer bowl 510
Equalize pressure to beer bowl 512 (counter-pressurize)
Supply liquid 514
Withdraw gas to beer bowl 516
Settle 518
Slow snift 520
Widget remains pressurized 522
Move to seamer 524
Apply can top 526

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION OF EMBODIMENTS

Figure 1:
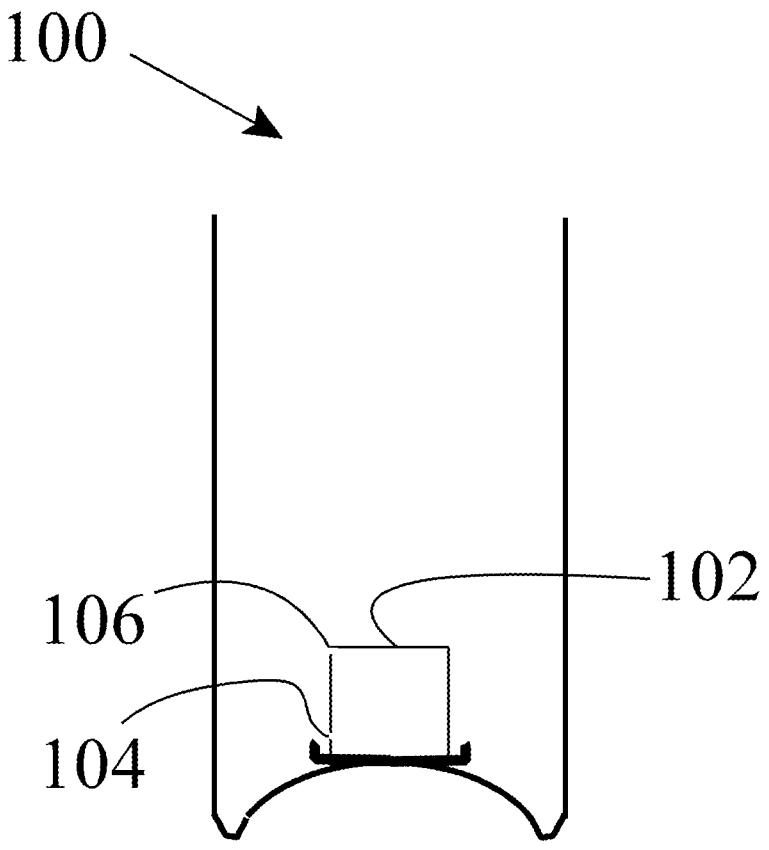
FIG. 1 is a cross-sectional side view of a topless can with a widget.

FIG. 1 is a cross-sectional side view of a topless can with a widget. Beer can, open top 100 has a normal proportion for a can which has not yet been "seamed", that is, has no top during the filling process.

Widget 102 sits atop the dome (the bottom of the can interior) with two openings from the widget interior to the can interior. Lower opening 104 and upper opening 106 allow the easy purging of oxygen from the widget and refilling the widget with N2 or CO2. So long as pressure is kept equalized, the small size of the openings (for example. 0.5 mm) means that the gas within the widget does not leave. When the can is opened, the immediate pressure drop causes outgassing from the widget into the beer.

Figure 2:
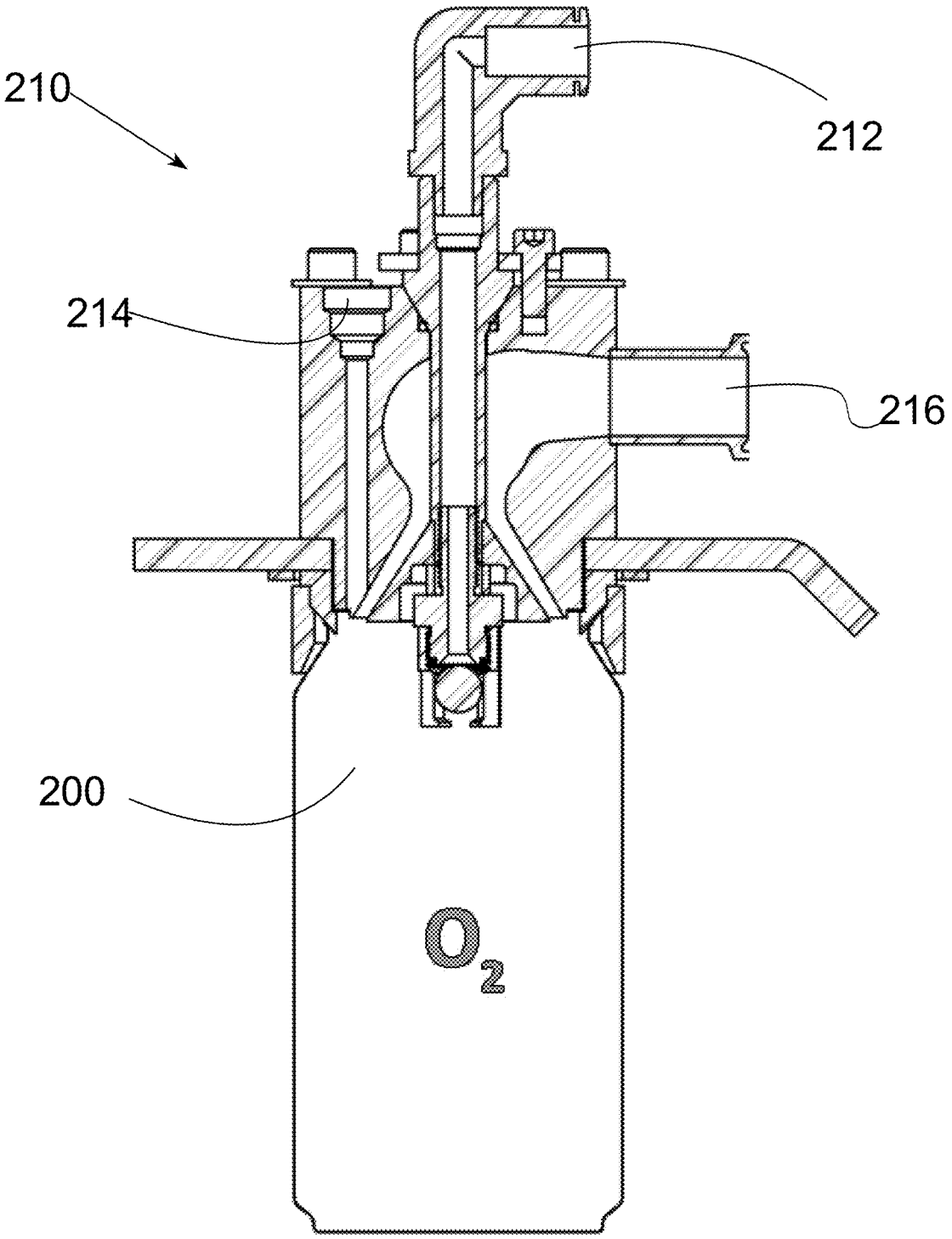
FIG. 2 is cross-sectional side view of a can under a fill head according to a preferred embodiment and best mode now contemplated for carrying out the invention.

FIG. 2 is cross-sectional side view of a can under a fill head according to a preferred embodiment and best mode now contemplated for carrying out the invention. Can 200 has fill head assembly 210 seated atop the open end, sealing it so pressure may be applied. This is in contrast to prior art craft brewery apparatus which have open gravity feed arrangements.

Figure 3:
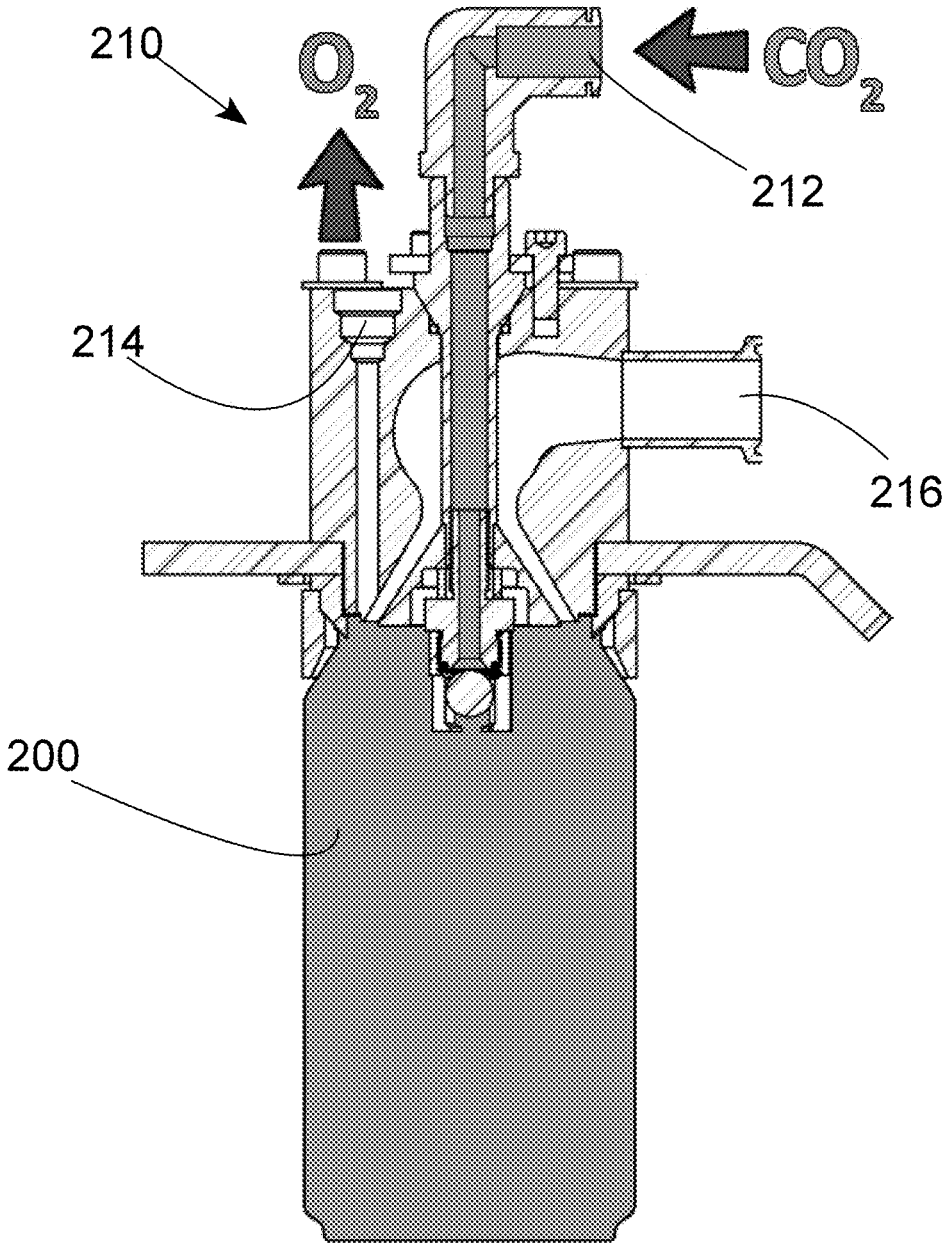
FIG. 3 is a cross-sectional side view of the same can during initial purge and pressurize.

FIG. 3 is a cross-sectional side view of the same can during initial purge and pressurize. Pressure is applied for the first time as CO2 inlet/outlet line 212 is being used to provide CO2 under pressure while the outlet line/snift line 214 is venting oxygen to a purge or to the atmosphere. (Oxygen is not allowable in a sealed beer can.)

Figure 4:
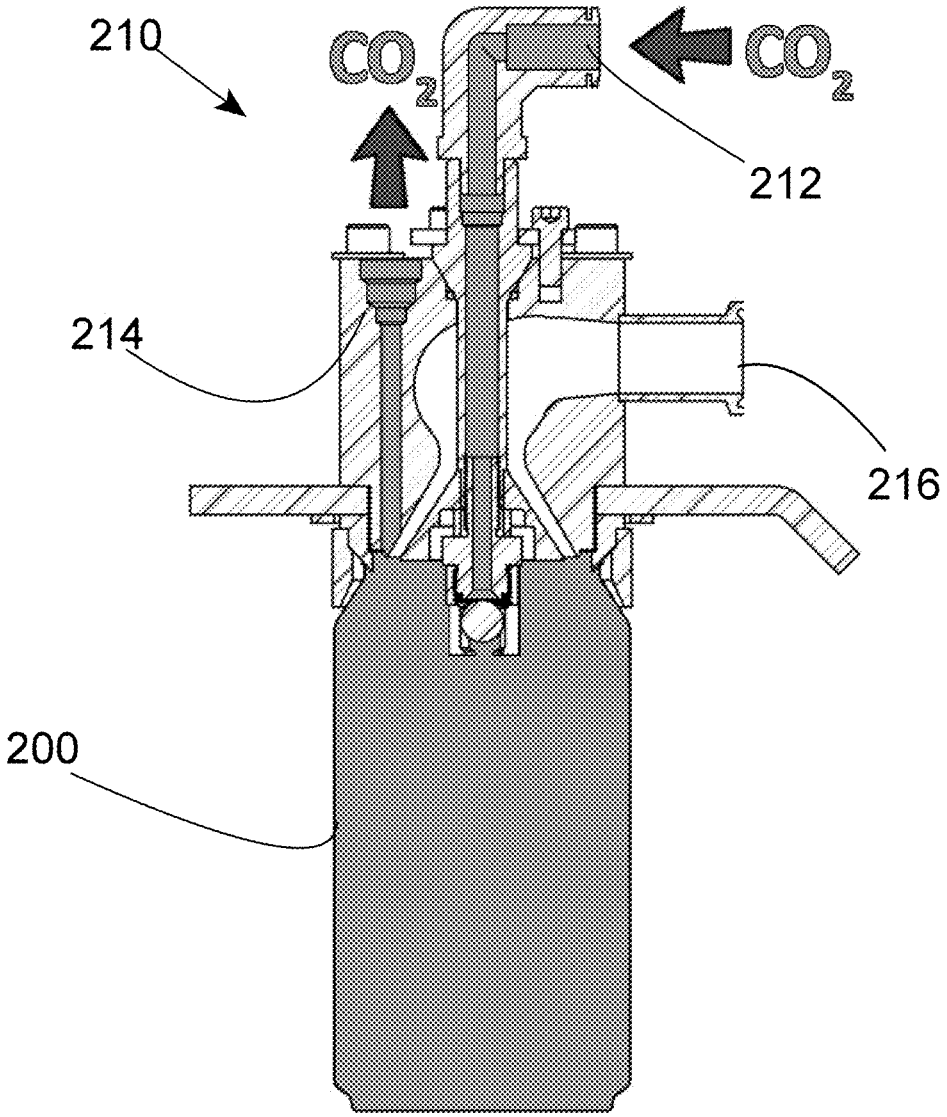
FIG. 4 is a cross-sectional side view of the same can during a second purge and pressurize for counter pressure.

FIG. 4 is a cross-sectional side view of the same can during a second purge and pressurize for counter pressure. CO2 is now being vented via the outlet line 214.

Figure 5:
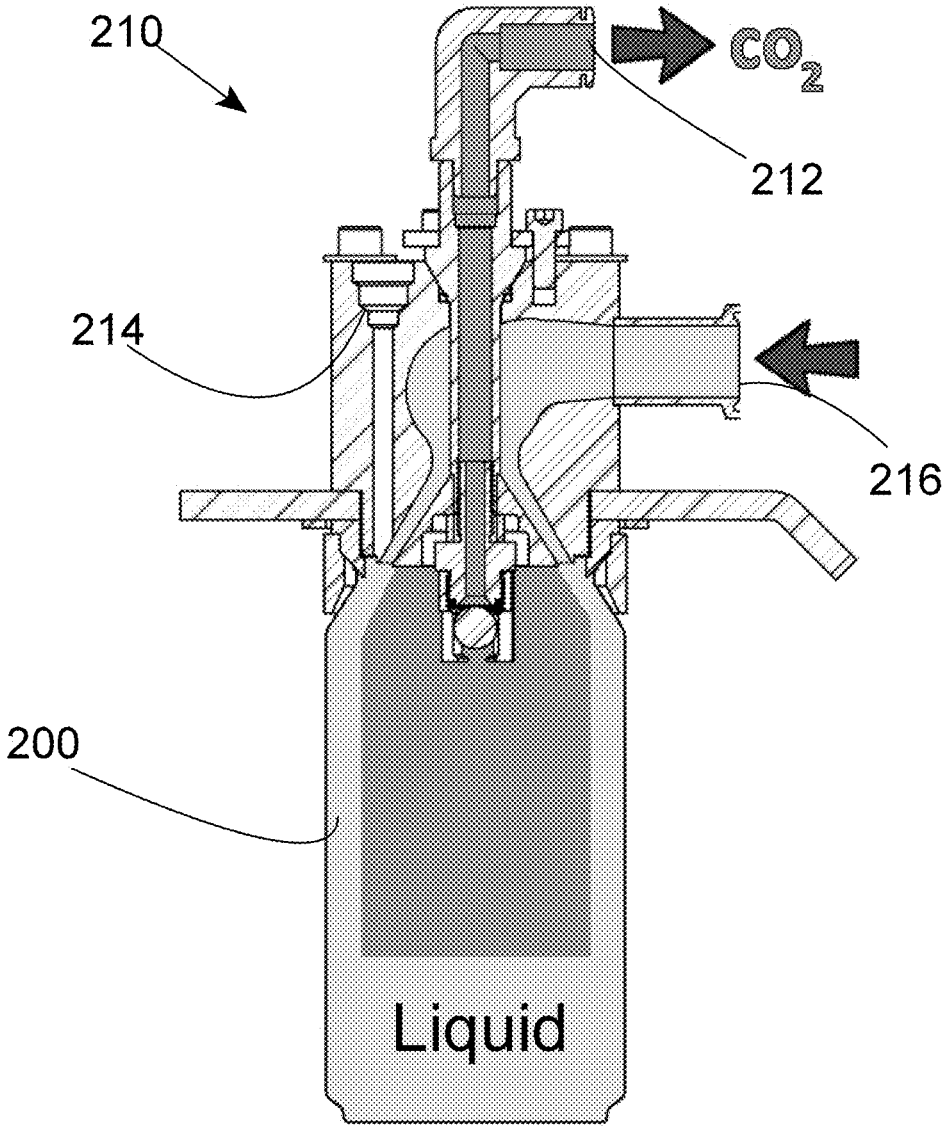
FIG. 5 is a cross-sectional side view of the same can as it is filling with beer or other liquid.

FIG. 5 is a cross-sectional side view of the same can as it is filling with beer or other liquid. Beer 215 is flowing in by way of liquid inlet line 216, then flowing down the interior sides of the can (due to the configuration of the vents in the fill head), leaving a smaller and smaller pocket of CO2. Note that the CO2 is now being removed by the inlet/outlet line 212, and that CO2 may flow to the beer bowl.

Figure 6:
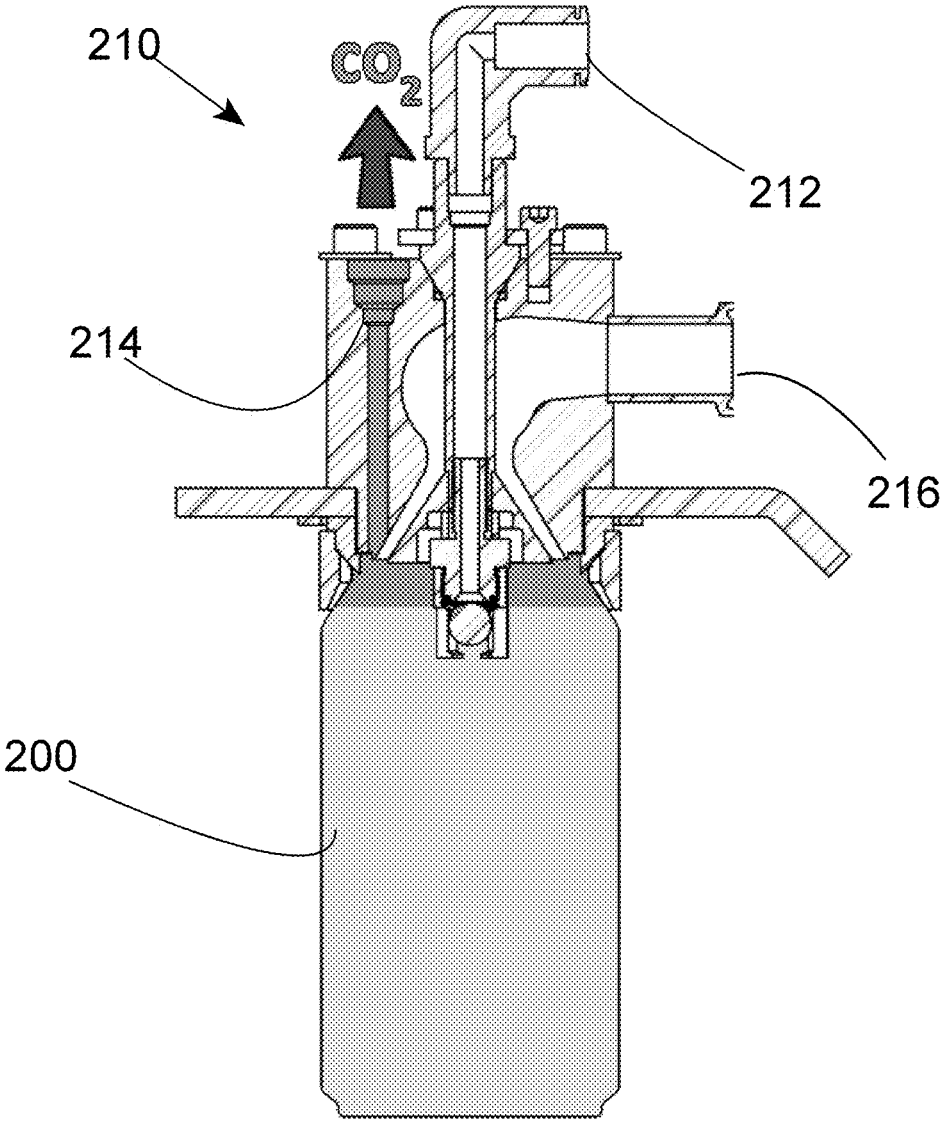
FIG. 6 is a cross-sectional side view of the same can during the "snift" as it is depressurized to atmospheric pressure.

FIG. 6 is a cross-sectional side view of the same can during the "snift" as it is depressurized to atmospheric pressure. CO2 at the top of the can interior is vented slowly until the pressure is reduced to the desired level, for example, atmospheric pressure.

It may be seen that the cycle used in this filling is different from prior art cycles, as the use of pinch valves allows different flows. In particular, gas pressure can be modulated by the pinch valves used in the equipment so that during fill, and during purges, and also during the pressure relief post-fill, the pressure may be reduced slowly. This advantageous in any beer can or other carbonated or pressurized beverage context, but it is especially useful in the context of a widget, as the widget may be charged without inverting the can.

In addition, it will be appreciated that the true double purge using CO2 offered by this system (in contrast to the prior art small scale equipment which does only a single, non-pressurized purge) allows a purge from the CO2 source but also a purge from the top of the beer bowl, that is from the CO2 present in the beer supply tank above the beer. In addition, there is no need for pre-measurement and the bowl of the invention can be placed beneath the fill head, lowering the center of gravity, saving space, and making the unit more portable.

Figure 7:
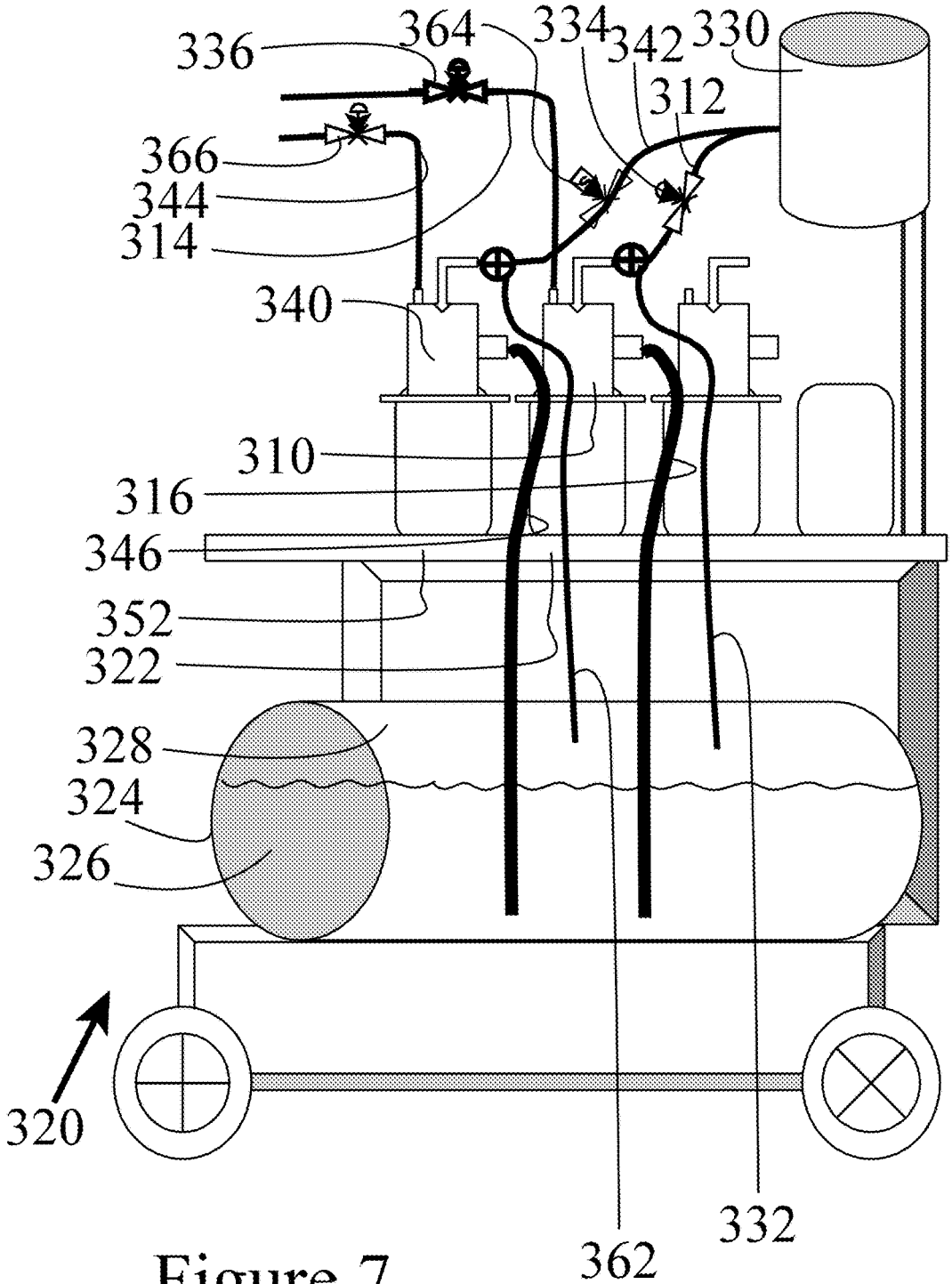
FIG. 7 is a schematic side view of a beer filling machine according to the invention.

FIG. 7 is a schematic side view of a beer filling machine 320 according to the invention. The machine has more than one beer filling station 322, the first having fill head assembly 310 as previously shown, which has a number of lines in and out of it: CO2 inlet/outlet line 312, outlet line/snift line 314, liquid inlet line 316, fill head to bowl CO2 line 332, and for the second beer filling station 352 there is a second fill head assembly 340 having additional CO2 inlet outlet line 342, outlet line/snift line 344, liquid inlet line 346, head to bowl CO2 line 362 etc.

Both beer filling stations 322 and 352 are supplied by beer supply bowl 324, which is partially filled with beer 326 above which is CO2 328. This CO2 328 above the beer in bowl is used as an additional source of CO2, a purge from the fill head/can and more, for example, this CO2 may be used for the second purge, while the gas source 330 is used for the first purge.

Importantly, the invention uses variable progressive valves 334, 336, 364 and 366 to control beer flow and CO2 pressure. These, as discussed, may allow gradual pressure application and withdrawal for faster and more effective filling of the cans. These may be, as shown in the diagrams, actuator/solenoid controlled pinch valves or the like, which testing has shown are vastly superior to known valves used in the industry in either large scale or small scale brewing and bottling. In addition, testing has shown that having one or more variable valves per can filling station is advantageous, as one valve controlling all five cans may not be as accurate in use.

Figure 8:
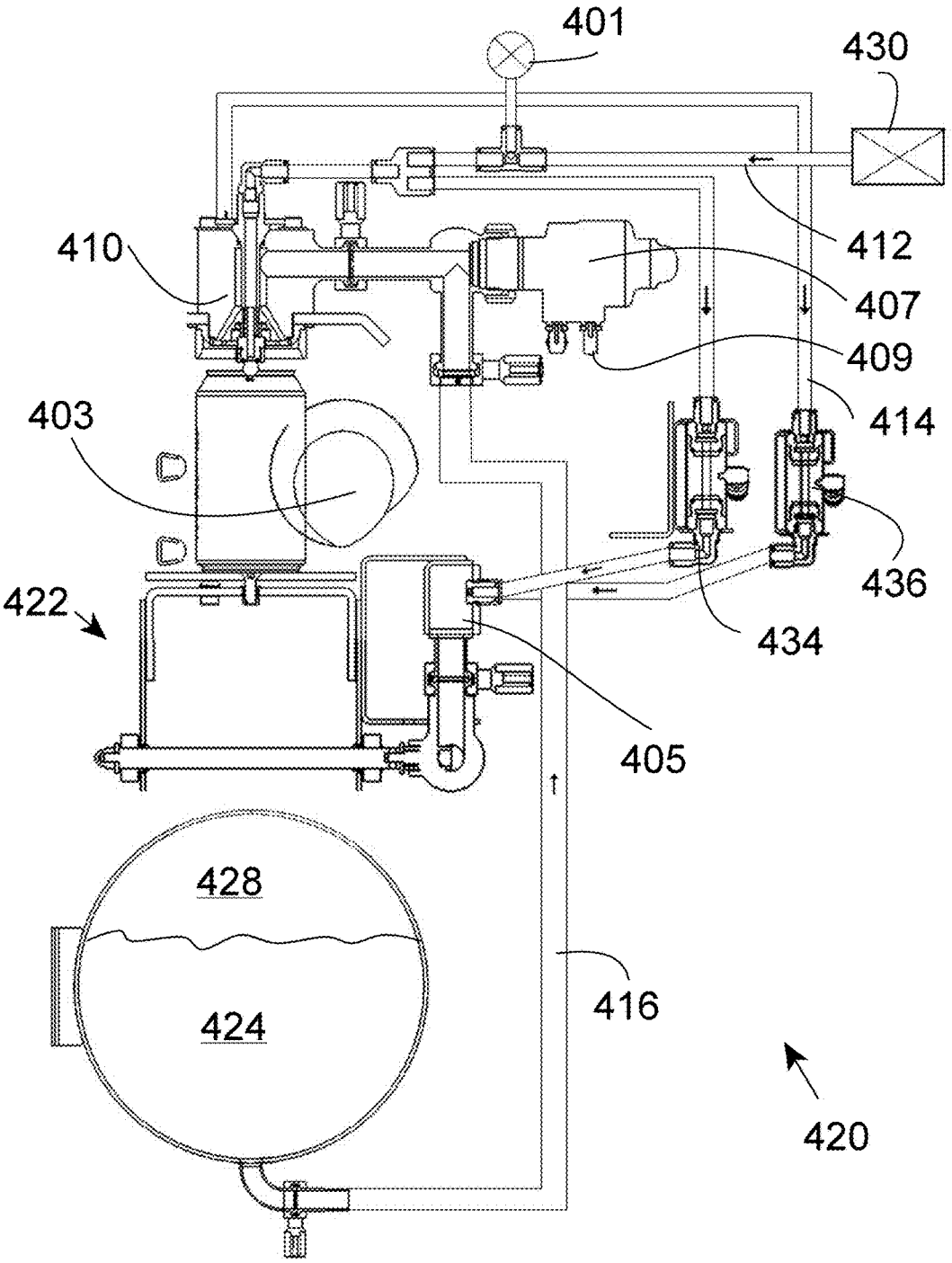
FIG. 8 is a side view of a beer filling machine according to the invention.

FIG. 8 is an end view, partially cross-sectional of a single filling station of a beer filling machine 420 according to the invention. It will be understood that in preferred embodiments there are five stations, however, from an end view and for clarity only a single station 422 is shown. In practice, this means that instead of the two variable progressive valves (pinch valves) shown, there are actually ten valves, two per station, and a plurality of conduits, lines, etc.

Pressure transducer 401 is used to measure pressure inside of the can and system during pressurization and other steps.

Worm drive screw 403 is seen in an end on view. The threading of the screw is large enough that a line of cans fits into it, one can in each thread, and the cans are moved (directly out of the plane of the drawing toward the viewer) as the screw 403 rotates. By this mean the screw 403 indexes each can into position at station 422 or another station, as well as moving the cans further forward to the seamer after filling is complete.

Purge manifold 405 also called the clean-in-place recirculation captures chemicals and volatiles from the CO2 gas leaving the system before the CO2 is purged into the ambient atmosphere.

On/Off valve 407 is controlled by air pressure fed to coupling 409: for clarity this coupling is shown but the additional line is omitted from this drawing. Note that the valve 407 does not actually control the flow of beer into the can, though it does prevent it or allow it. In use, this valve is only opened after the counterpressure has been applied to the can, that is, this valve is shut while the pressure in the can is matched to the pressure in the beer supply bowl. When they are connected and pressure is equalized, the valve 407 is opened. Since the pressure has been equalized however, no beer flows through the open conduit 416 just yet. Rather, the gentle opening of variable progressive valve 434 allows the pressure in the can to drop by a very delicate and deliberate increment and beer begins to flow per FIG. 5.

Fill head assembly 410 is as described in FIGS. 2 through 6. It may be seen that the float ball valve is used to help regulate beer fill and to prevent overfill.

CO2 inlet/outlet line 412 comes from the gas source 430.

Outlet line/snift line 414 has thereon variable valve 436 which also allows the final snift step (reducing pressure to atmospheric pressure after filling is complete) to be carried out in a controlled manner, with the objective of keeping the widget pressurized by avoiding sudden pressure changes which would allow gas in the widget to escape.

Liquid inlet line 416 runs from the beer supply bowl 424 to the fill head 410. Notice that variable valve 436 may be used to carry out the beer filling operation without undue sudden pressure variations which would discharge the widget. After the can and widget have been pressurized, on/off valve 407 is opened while pinch valve 434 is allowed to gently release pressure from the can and fill head. Pressure in the beer supply bowl 424 drives beer or other product up line 416 and into the can as shown previously in FIG. 5, but without any pressure spikes or dips which would cause the CO2 or N2 previously charged into the widget (see FIGS. 3 and 4) to become discharged.

Beer supply bowl 424 has above the actual beer, in the head space 424 of the bowl, pressurized CO2. This pressurized CO2 is not only used to drive beer up line 416, it is also used for the counterpressure step (see FIG. 4), when the gas line (not visible in this view, see 332 and 362 of FIG. 7 for an example) from the top of the bowl to the fill head is opened.

The head to bowl CO2 line (not visible in this view) allows equalization of pressure between the can and the beer supply bowl: when the valve controlling this conduit is open, pressure may equalize and gas may in fact flow in either direction: from the bowl to the can or vice-versa.

Variable progressive valve 434 and variable progressive valve 436, along with the counterpressurization of the can to equal the beer supply bowl are thus all crucial to maintaining the widget in a charged state, since each of these parts and steps is necessary to keep the gas on the inside of the ½ mm holes of the widget from expanding out of the hole. For example, if valve 434 was a simple on/off valve such as valve 407, when it was opened to begin allowing beer in, the sudden pressure change in the system and in the can would get the gas in the widget flowing out the holes. Similarly, if the snift valve 436 was a simple on/off, when the can pressure was reduced to ambient there would be a sudden plunge in pressure and the widget would outgas.

Outlet line/snift line 414, unlike the head to bowl line, purges completely from the can to ambient atmosphere or other gas disposal volumes. As discussed previously, by using valves allowing fine control, in particular with valves which can partially open such as progressive valves, it is possible to depressurize the can slowly enough that the equilibrium of the widget, which has very small holes therein (0.5 millimeter, as discussed previously) is not disturbed and the widget remains pressurized with gas at the pressure established during filling, the pressure of the beer supply bowl or the gas supply, even though the can in which it sits slowly depressuizes to ambient pressure. This is due to the small size of the holes where the gas inside the widget is in contact with the beer outside the widget inside the can. As noted previously, when a user opens the can the pressure drop is quite dramatic by comparison and that change instantly disturbs the equilibrium of the widget holes and the gas floods out through the holes into the beer, instantly carbonating (or nitrogen over-saturating) the beer or other liquid.

Figure 9:
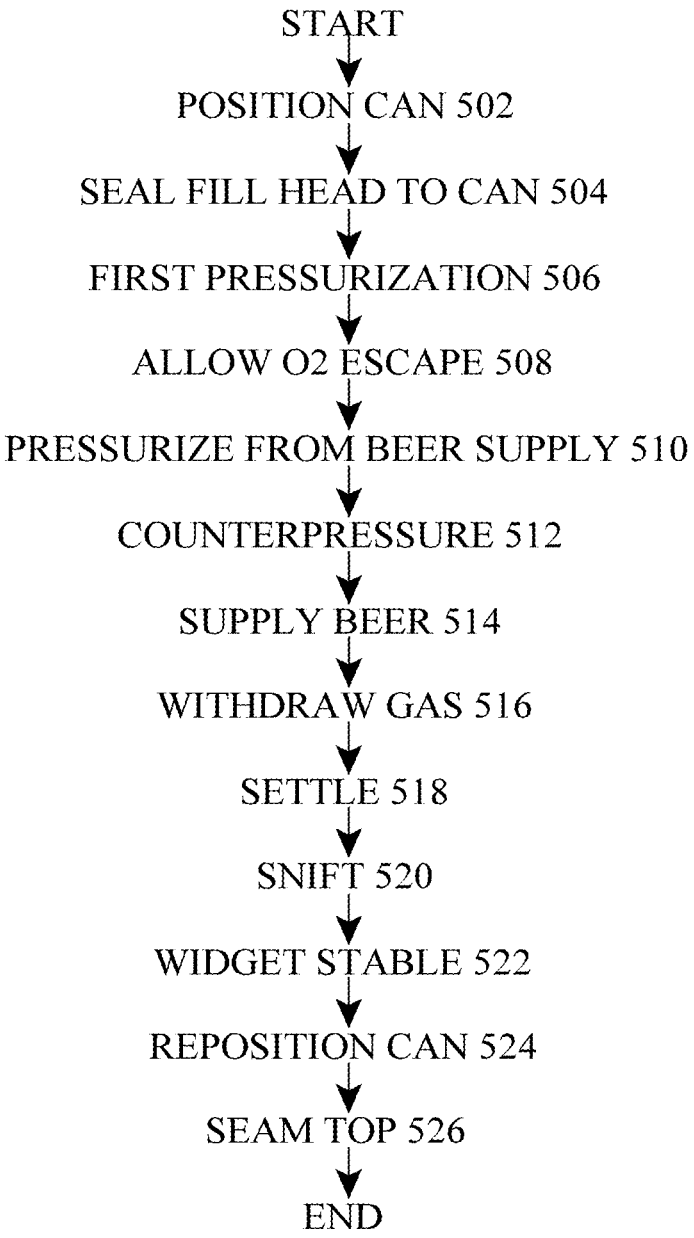
FIG. 9 is a flow chart of the steps of the process of the invention.

FIG. 9 is a flow chart of the steps of the process of filing a can using the device of the invention. The method of filling is in fact key to the invention, in particular the use of multiple pressurize and purge cycles combined with variable progressive valves allowing a widget to be filled with gas while upright and quite quickly in comparison to the multiple cycle method of prior art discussed above (six seconds, four seconds, six seconds, four seconds, etc).

In a preferred method and best embodiment of the invention, a can is indexed 502 below the fill head and the fill head sealed 504 to the can, then a variable pressure valve (as opposed to a binary on-off valve) is used to provide (506) CO2 or N2 from a CO2/N2 source through a first inlet line. At the same time, oxygen is allowed to leave 508 the can through a second outlet line. Then as CO2 is provided (506) to the can, the can is pressurized 510 from the CO2 in the beer bowl, (by way of the same port in the fill head as the first inlet line, but using a third head-to-bowl gas line) thus equalizing pressure 512 to that of the beer bowl pressure and allowing counter pressure for later steps. During this second purge CO2 is allowed to escape from the second outlet line. Next, liquid is supplied 514 (beer, other carbonated beverages, etc) from the beer bowl while CO2 is withdrawn 516 back into the beer bowl from the can by way of the head to bowl gas line. A settle step 518 allows the beer to settle in place from running down the walls of the can, and allows the CO2 or N2 gas to gather at the top before a "snift" step 520 in which the variable valves are yet again used to slowly bring the can down to ambient pressure by allowing CO2 to escape via the second outlet line, but keeping the widget pressurized 522. Finally, the can is moved 524 to a seamer and the top applied 526.

Throughout this application, various publications, patents, and/or patent applications are referenced in order to more fully describe the state of the art to which this invention pertains. The disclosures of these publications, patents, and/or patent applications are herein incorporated by reference in their entireties, and for the subject matter for which they are specifically referenced in the same or a prior sentence, to the same extent as if each independent publication, patent, and/or patent application was specifically and individually indicated to be incorporated by reference.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. A beer filling machine for use with a beer can having an open top and a widget, the beer filling machine comprising:

a first fill station, the first fill station dimensioned and configured to hold such beer can in place for filling;

a fill head dimensioned and configured to be lowered to sit atop such beer can, the fill head in liquid and gas communication with such beer can;

a beer supply bowl located below the fill head;

a pressurized gas source;

a first beer conduit connecting the beer supply bowl to the fill head;

a second gas conduit connecting the gas source to the fill head;

a third gas conduit connecting the fill head to the beer supply bowl head space;

a fourth snift line connecting the fill head to a purge;

a first variable progressive valve on the snift line;

a second variable progressive valve on the second gas conduit;

a third variable progressive valve on the third gas conduit;

whereby such can may be filled from the beer supply bowl by means of variable controlled pressure controlled by the variable progressive valves, and further whereby such widget may be filled with gas from the gas source by means of variable controlled gas pressure controlled by the variable progressive valves.

2. The beer filling machine of claim 1, wherein the gas is one member selected from the group consisting of: CO2, N2, other inert gases, other food-grade gases, and combinations thereof.

3. The beer filling machine of claim 1, further comprising:

a seamer disposed adjacent the first fill station, the seamer operative to affix a top to such can.

4. The beer filling machine of claim 1 for use with a second can having therein a second widget, the beer filling machine further comprising:

a second fill station, the second fill station dimensioned and configured to hold such second beer can in place for filling;

a second fill head dimensioned and configured to sit atop such second beer can, the second fill head in liquid and gas communication with such second beer can;

a fifth beer conduit connecting the beer supply bowl to the second fill head;

a sixth gas conduit connecting the gas source to the second fill head;

a seventh gas conduit connecting the second fill head to the beer supply bowl;

an eighth snift line connecting the second fill head to the purge;

a fourth variable progressive valve on the eighth snift line;

a fifth variable progressive valve on the third gas conduit;

whereby such second can may be filled from the beer supply bowl by means of variable controlled pressure controlled by the variable progressive valves, simultaneously with the filling of such first can;

and further whereby such second widget may be filled with gas from the gas source by means of variable controlled gas pressure controlled by the variable progressive valves, simultaneously with the filling of such first can's widget.

5. The beer filling machine of claim 3, further comprising: the variable progressive valves being controlled by variable air pressure.

6. The beer filing machine of claim 5, further comprising: a means for positioning such can in the first fill station and repositioning such can in such seamer.

7. The beer filling machine of claim 6, further comprising a programmable logic controller operative to control the first through fifth valves by controlling the variable air pressure lines, and further operative to control the pressurized gas source, the lowering of the fill head and the means for positioning the can.

8. A method of filling a beer can having an open top and a widget, the method comprising the steps of:

providing a beer filling machine comprising: a first fill station, the first fill station dimensioned and configured to hold such beer can in place for filling; a fill head dimensioned and configured to sit atop such beer can, the fill head in liquid and gas communication with such beer can; a beer supply bowl located below the fill head; a pressurized gas source; a first beer conduit connecting the beer supply bowl to the fill head; a second gas conduit connecting the gas source to the fill head; a third gas conduit connecting the fill head to the beer supply bowl;

a fourth snift line connecting the fill head to a purge; a first variable progressive valve on the snift line; a second variable progressive valve on the second gas conduit; and a third variable progressive valve on the third gas conduit; a seamer adjacent the first fill station;

positioning such can in the first fill station;

sealing the fill head to the top of such beer can;

in a first pressurization and first purge step, opening the first and second variable progressive valves so that gas flows from the pressurized gas source via the second gas conduit to the fill head and then into such can while allowing air within such can to leave the can via the fourth snift line, thereby pressurizing the can and the widget with gas;

in a second pressurization and purge step, closing the first and second variable progressive valves and opening the third variable progressive valve so that such can becomes pressurized from the beer supply bowl rather than the gas source and allowing pressure in such can to equalize to pressure in the beer supply bowl and creating counterpressure for later steps of the filing;

maintaining the counter pressure while supplying liquid from the beer supply bowl to such can via the first beer conduit;

allowing the liquid to settle in such can whereby gas remaining in such can gathers at the top of such can;

snifting the can by closing the third progressive variable valve and closing the first beer conduit, but partially opening the first variable progressive valve on the fourth snift line, the partial opening sufficient to allow such can to depressurize down to an ambient air pressure by purging via the fourth snift line but insufficient to cause such widget to depressurize;

moving such can to a seamer;

seaming a top onto such can.

9. The method of filling a beer can of claim 8, further comprising:

providing variable air pressure lines;

controlling the variable progressive valves by means of variable air pressure lines.

10. The method of filing a beer can of claim 9, further comprising:

providing a means for positioning such can in the first fill station and repositioning such can in such seamer.

11. The method of filling a beer can of claim 10, further comprising:

providing a programmable logic controller operative to control the first through fifth valves by controlling the variable air pressure lines, and operative to control the pressurized gas source, the lowering of the fill head and the means for positioning the can.

* * * * *